US011246460B2

(12) United States Patent
Osborne, Jr.

(10) Patent No.: US 11,246,460 B2
(45) Date of Patent: Feb. 15, 2022

(54) SHEET MATERIAL DISPENSER ASSEMBLY FOR SELECTIVELY DISPENSING SHEET MATERIAL FROM A PLURALITY OF SUPPLIES OF ROLLED SHEET MATERIAL

(71) Applicant: Charles Agnew Osborne, Jr., Cumming, GA (US)

(72) Inventor: Charles Agnew Osborne, Jr., Cumming, GA (US)

( * ) Notice: Subject to any disclaimer, the term of this patent is extended or adjusted under 35 U.S.C. 154(b) by 265 days.

(21) Appl. No.: 16/692,105

(22) Filed: Nov. 22, 2019

(65) Prior Publication Data

US 2020/0163498 A1 May 28, 2020

Related U.S. Application Data

(60) Provisional application No. 62/772,199, filed on Nov. 28, 2018.

(51) Int. Cl.
*A47K 10/36* (2006.01)

(52) U.S. Cl.
CPC ..... *A47K 10/3687* (2013.01); *A47K 10/3612* (2013.01); *A47K 10/3618* (2013.01)

(58) Field of Classification Search
CPC ..... A47K 10/3612; A47K 10/3625; A47K 10/3687; A47K 10/36; A47K 10/3618; A47K 10/38; A47K 2010/3253
See application file for complete search history.

(56) References Cited

U.S. PATENT DOCUMENTS 2,826,373 A 3/1958 Schwartz
3,007,650 A * 11/1961 Burton ..... A47K 10/36 242/560.1

(Continued)

FOREIGN PATENT DOCUMENTS

EP 522477 B1 10/1995
EP 1915080 B1 12/2008

(Continued)

OTHER PUBLICATIONS

International Preliminary Report on Patentability for PCT/US2019/062795 dated Jun. 10, 2021.

(Continued)

*Primary Examiner* — Michael E Gallion
(74) *Attorney, Agent, or Firm* — Womble Bond Dickinson (US) LLP

(57) ABSTRACT

A dispenser assembly facilitating selective dispensing of sheet material from a plurality of supplies of sheet material can be provided. The dispenser assembly can include a drive system to facilitate dispensing of the sheet material from the plurality of supplies of sheet material from the dispenser. The drive system can include a plurality of driven rollers each configured to engage and move sheet material from a respective supply of sheet material, and a drive mechanism driving the plurality of driven rollers and connected thereto by a belt driven transmission. When the drive mechanism is driven in one direction, one of the plurality of driven rollers is rotated to dispense sheet material from one of the plurality of supplies of sheet material, and when the drive mechanism is driven in the opposite direction, another one of the plurality of driven rollers is rotated to dispense sheet material from another supply of sheet material.

20 Claims, 8 Drawing Sheets

(56) References Cited

U.S. PATENT DOCUMENTS 3,132,782 A 5/1964 Coates, Jr.
3,737,087 A 6/1973 Rooklyn
4,148,442 A 4/1979 Baumann et al.
4,260,117 A 4/1981 Perrin et al.
4,432,482 A 2/1984 Beausoleil
4,634,192 A * 1/1987 Fielding ..... A47K 10/28 312/34.22
5,400,982 A 3/1995 Collins
6,363,824 B1 * 4/2002 Granger ..... A47K 10/3643 242/560
6,412,679 B2 7/2002 Formon et al.
6,426,701 B1 7/2002 Levy et al.
6,592,067 B2 7/2003 Denen et al.
6,685,074 B2 2/2004 Gracyalny et al.
6,736,348 B1 * 5/2004 Formon ..... A47K 10/3687 242/559.4
6,742,689 B2 6/2004 Formon et al.
6,892,620 B2 5/2005 Kapiloff
6,903,654 B2 6/2005 Hansen et al.
6,977,588 B2 12/2005 Schotz et al.
7,040,566 B1 5/2006 Rodrian et al.
7,182,288 B2 2/2007 Denen et al.
7,185,841 B2 * 3/2007 Kaufmann ..... A47K 10/32 242/564.4
7,213,782 B2 5/2007 Osborne et al.
7,296,765 B2 11/2007 Rodrian
7,341,170 B2 3/2008 Boone
7,370,824 B1 5/2008 Osborne
7,380,748 B2 6/2008 Goeking et al.
7,398,944 B2 7/2008 Lewis et al.
7,460,013 B1 12/2008 Osborne
7,523,885 B2 4/2009 Lewis
7,533,845 B2 5/2009 Neveu et al.
7,554,084 B2 6/2009 Mok et al.
7,594,622 B2 9/2009 Witt et al.
7,698,980 B2 4/2010 Morris et al.
7,726,599 B2 6/2010 Lewis et al.
7,735,770 B2 6/2010 Conner
7,774,096 B2 8/2010 Goerg et al.
7,783,380 B2 8/2010 York et al.
7,793,882 B2 9/2010 Reinsel et al.
7,795,584 B2 9/2010 Mok et al.
7,821,155 B2 10/2010 Reinsel et al.
7,837,077 B2 11/2010 Formon et al.
7,841,556 B2 * 11/2010 Elliott ..... A47K 10/3687 242/564.2
7,845,593 B2 12/2010 Formon et al.
7,878,446 B2 2/2011 Reinsel et al.
7,931,228 B2 4/2011 Omdoll
7,963,475 B2 6/2011 Rodrian et al.
7,984,872 B2 7/2011 Kuehneman et al.
8,066,217 B2 11/2011 Cittadino et al.
8,082,827 B2 12/2011 Friesen et al.
8,082,828 B2 12/2011 Formon et al.
8,160,742 B2 4/2012 Goerg et al.
8,165,716 B1 4/2012 Goeking et al.
8,186,551 B2 5/2012 Morris et al.
8,651,003 B1 2/2014 Vercellone
8,800,415 B2 8/2014 Osborne
9,370,283 B2 6/2016 Fellhoelter
9,741,233 B2 8/2017 Laufer et al.
9,756,992 B2 9/2017 Osborne, Jr.
9,907,441 B2 * 3/2018 Osborne, Jr. ..... A47K 10/3625
9,972,193 B2 5/2018 Laufer et al.
10,105,020 B2 10/2018 Carper et al.
10,123,665 B2 11/2018 Osborne, Jr. et al.
10,136,769 B2 11/2018 Osborne, Jr. et al.
10,149,579 B2 * 12/2018 Goltz ..... A47K 10/3618
10,299,638 B2 5/2019 Henson et al.
10,441,117 B2 10/2019 Osborne, Jr.
10,446,013 B2 10/2019 Laufer et al.
11,109,721 B2 * 9/2021 Williams, Jr. ..... A47K 10/3687
2003/0110911 A1 * 6/2003 Kapiloff ..... A47K 10/36 83/208
2004/0004152 A1 1/2004 Kapiloff et al.
2005/0167541 A1 8/2005 Osborne
2005/0171634 A1 8/2005 York et al.
2007/0152010 A1 7/2007 Denen et al.
2007/0194166 A1 8/2007 Reinsel et al.
2007/0194167 A1 8/2007 Denen et al.
2008/0011772 A1 1/2008 Morris et al.
2008/0018302 A1 1/2008 Reinsel et al.
2008/0048064 A1 2/2008 Lemaire et al.
2008/0078777 A1 4/2008 Cittadino et al.
2008/0087758 A1 4/2008 Formon et al.
2008/0217350 A1 9/2008 Hansen et al.
2008/0245922 A1 10/2008 Fellhoelter
2009/0101751 A1 4/2009 Cittadino et al.
2009/0120952 A1 5/2009 Cattacin et al.
2009/0177315 A1 7/2009 Goeking et al.
2009/0217870 A1 9/2009 Luu
2010/0044407 A1 2/2010 Yardley
2010/0170979 A1 7/2010 Lewis et al.
2010/0286817 A1 * 11/2010 Goeking ..... A47K 10/26 700/231
2010/0286818 A1 11/2010 Goeking et al.
2011/0114782 A1 5/2011 Rodrian et al.
2012/0167739 A1 7/2012 Lewis et al.
2012/0255413 A1 10/2012 Osborne, Jr.
2012/0312853 A1 12/2012 Osborne et al.
2013/0161346 A1 6/2013 Wolme et al.
2013/0320130 A1 12/2013 Osborne, Jr.
2014/0158809 A1 * 6/2014 Borke ..... A47K 10/36 242/563
2014/0263812 A1 9/2014 Osborne
2015/0157177 A1 6/2015 Carper et al.
2015/0238056 A1 8/2015 Fellhoelter
2015/0297043 A1 * 10/2015 Osborne, Jr. ..... A47K 10/3612 242/563.2
2016/0227970 A1 * 8/2016 Diamond ..... B65H 35/0086
2016/0353945 A1 * 12/2016 Osborne, Jr. ..... B65H 20/02
2016/0353946 A1 12/2016 Osborne
2016/0353947 A1 * 12/2016 Osborne, Jr. ..... B65H 16/106
2017/0320697 A1 11/2017 Merkel et al.
2017/0367547 A1 12/2017 Osborne
2018/0153360 A1 6/2018 Osborne, Jr. et al.
2018/0170703 A1 * 6/2018 Osborne, Jr. ..... A47K 10/3618
2018/0263433 A1 9/2018 Osborne, Jr.
2019/0174972 A1 6/2019 Osborne, Jr. et al.
2019/0350414 A1 * 11/2019 Starkey ..... A47K 10/3625
2019/0380546 A1 * 12/2019 Sexton ..... A47K 10/36
2021/0085136 A1 * 3/2021 Bartman ..... A47K 13/22

FOREIGN PATENT DOCUMENTS

JP 4594187 B2 12/2010
WO WO-0035328 A1 * 6/2000 ..... A47K 10/36

OTHER PUBLICATIONS

International Search Report and the Written Opinion of the International Search Authority for PCT/US2019/062795, dated Mar. 23, 2020.

* cited by examiner

SHEET MATERIAL DISPENSER ASSEMBLY FOR SELECTIVELY DISPENSING SHEET MATERIAL FROM A PLURALITY OF SUPPLIES OF ROLLED SHEET MATERIAL

CROSS-REFERENCE TO RELATED APPLICATIONS

The present application claims the benefit of U.S. Provisional Patent Application No. 62/772,199, filed on Nov. 28, 2018.

INCORPORATION BY REFERENCE

The disclosure and figures of U.S. Provisional Patent Application No. 62/772,199, filed on Nov. 28, 2018, are specifically incorporated by reference herein as if set forth in their entireties.

TECHNICAL FIELD

In one aspect, the present disclosure is directed to dispenser assemblies for rolled sheet materials, and more particularly, is directed to dispenser assemblies for selectively dispensing from a plurality of supplies of rolled sheet material. Other aspects are also described.

BACKGROUND

Dispensers for sheet materials, such as for dispensing tissue paper, paper towels, or other paper products, are commonly used in hospitals, restrooms, and other facilities. Some dispensers have more than one supply of sheet material, e.g., multiple rolls of sheet material, for dispensing/feeding. When a supply of sheet material in such dispensers is running low or has been fully dispensed, a transfer of the feeding of sheet material to a new supply generally must be performed, which often must be done manually. Accordingly, it can be seen that a need exists for a dispenser assembly that can selectively switch/transfer the feeding/dispensing of sheet material between a plurality of supplies of sheet material between a plurality of supplies of sheet material, e.g., when a supply of sheet material is running low or has been fully dispensed. The present disclosure addresses these and other related and unrelated problems/issues in the relevant art.

SUMMARY

In one aspect, the present disclosure is directed to a dispenser assembly for dispensing sheet materials such as rolls of tissue, paper towels, and/or other rolled sheet material products. The dispenser assembly generally includes a dispenser housing having a plurality of supplies of rolled sheet material supported therein.

Each supply of rolled sheet material is supported by a corresponding support assembly within the dispenser housing. In one construction, the plurality of supplies of sheet material can include a first supply of sheet material supported by a corresponding first support assembly, and a second supply of sheet material supported by a corresponding second support assembly. The first and second support assemblies can be spaced apart from each other along the dispenser housing.

The dispenser assembly further can include a dispensing system for controlling the dispensing of selected, predetermined amounts of sheet material from at least one of the plurality of supplies of sheet material. The dispensing system can include a plurality of driven roller assemblies for engaging and driving the sheet material from the supplies of rolled sheet material. Each driven roller assembly generally will be associated with at least one supply of the plurality of supplies of sheet material for dispensing sheet material therefrom. For example, the first supply of rolled sheet material can be dispensed by a first driven roller assembly and the second supply of rolled sheet material can be dispensed by a second driven roller assembly.

Each driven roller assembly can have at least one driven roller driven by a drive mechanism (e.g., a motor or other suitable drive mechanism) in communication therewith. In one variation, the drive mechanism can be operatively connected to the driven roller(s) by a belt or series of belts (e.g., one or more belts engaging a belt pulley or belt gear connected to each of the driven rollers).

The dispensing assembly further can include at least one guide roller that engages the sheet material and is rotatable with the rotation of the driven roller to help facilitate feeding and dispensing of the sheet material.

The dispenser assembly further can include additional guide or pressing rollers positioned adjacent each of the driven rollers to help guide the sheet material during dispensing thereof without departing from the scope of the present disclosure.

Each of the driven rollers can be configured to rotate in a desired or selected direction, and typically can be rotated by the drive mechanism for a selected number of rotations as needed to dispense the selected amounts of sheet material from their corresponding supply of rolled sheet material, but generally will remain stationary when the drive mechanism is reversed or driven in the opposite direction. For example, each driven roller can include or can be coupled to a clutch mechanism (e.g., a hybrid or one-way clutch mechanism) or other disengageable drive connection that engages the driven roller and causes it to rotate when driven/rotated in one direction and disengages the driven roller and allows it to stay substantially stationary when driven in the opposite direction.

For example, the first driven roller can be rotated when the drive mechanism is driven in a first direction to dispense sheet material from the first supply of rolled sheet material, while the second driven roller can remain generally stationary such that sheet material is not dispensed from the second supply of rolled sheet material. When the drive mechanism is driven in a second direction, the second driven roller can be rotated to dispense selected predetermined amounts of sheet material from the second supply of rolled sheet material, while the first driven roller can be disengaged and remain generally stationary such that sheet material is not dispensed therefrom.

Accordingly, the dispenser assembly of the present disclosure provides for selective dispensing of sheet material from the plurality of supplies of sheet material as needed. For example, upon a change or reversing of the driving direction of the drive mechanism, the dispenser can switch the dispensing of sheet material from the one supply of sheet material to the other. This change or switch/transfer of feeding from one supply to another can be substantially automatic, i.e., in response to a signal from a sensor or monitoring system, by a command from a control system for the dispenser, manually by a switch upon receipt of one or more signals from a device external to the dispenser assembly, etc.

The drive assembly additionally can include a tensioning assembly including one or more biasing members for providing a substantially constant tension along the drive belt. In one variation, the one or more biasing members (e.g., including one or more tension springs) can be operatively connected to the motor (e.g., one end of the one or more springs can be connected to the motor or a support therefor, and another end of the one or more springs can be connected to the dispenser housing or a component attached thereto).

The tensioning assembly can include a bracket movably supporting the drive mechanism along the dispenser housing, and the one or more biasing members can be coupled to the bracket to bias the tensioning assembly sufficient to apply tension along the drive belt and/or for providing dampening of vibrations from an operation of the dispenser assembly.

The dispenser assembly can include at least one cutting mechanism (e.g., including a tear bar(s), serrated cutting blade(s), knife(s), or other sharpened portion(s)) positioned along the discharge of the dispenser housing for severance of dispensed sheet material from the supplies of sheet material.

The dispenser assembly can include pawl member assembly including a pivotally mounted pawl member located proximate or otherwise along the cutting mechanism such that movement of the sheet material into the cutting mechanism for severance thereof moves the pawl member from a first position to a second position. The pawl member assembly further can generate one or more signals that can be sent to a control circuit of the dispenser to notify the control circuit that a portion of the dispensed sheet material has been removed.

The dispensing assembly also can include a sheet material detection sensor including an emitter and a detector focused across at least a portion of the discharge path(s) extending through the discharge. The sheet material detection sensor can be activated by a control system of the dispenser assembly to verify that the sheet material has been removed from the discharge.

The dispensing assembly further can include a monitoring system configured to determine a supply level of the supplies of sheet material, and upon a determination that the supply level of the supplies of sheet material is below a threshold level, the direction of the drive mechanism can be changed.

Various objects, features and advantages of the present disclosure will become apparent to those skilled in the art upon a review of the following detail description, when taken in conjunction with the accompanying drawings.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

DETAILED DESCRIPTION

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

Figure 1:
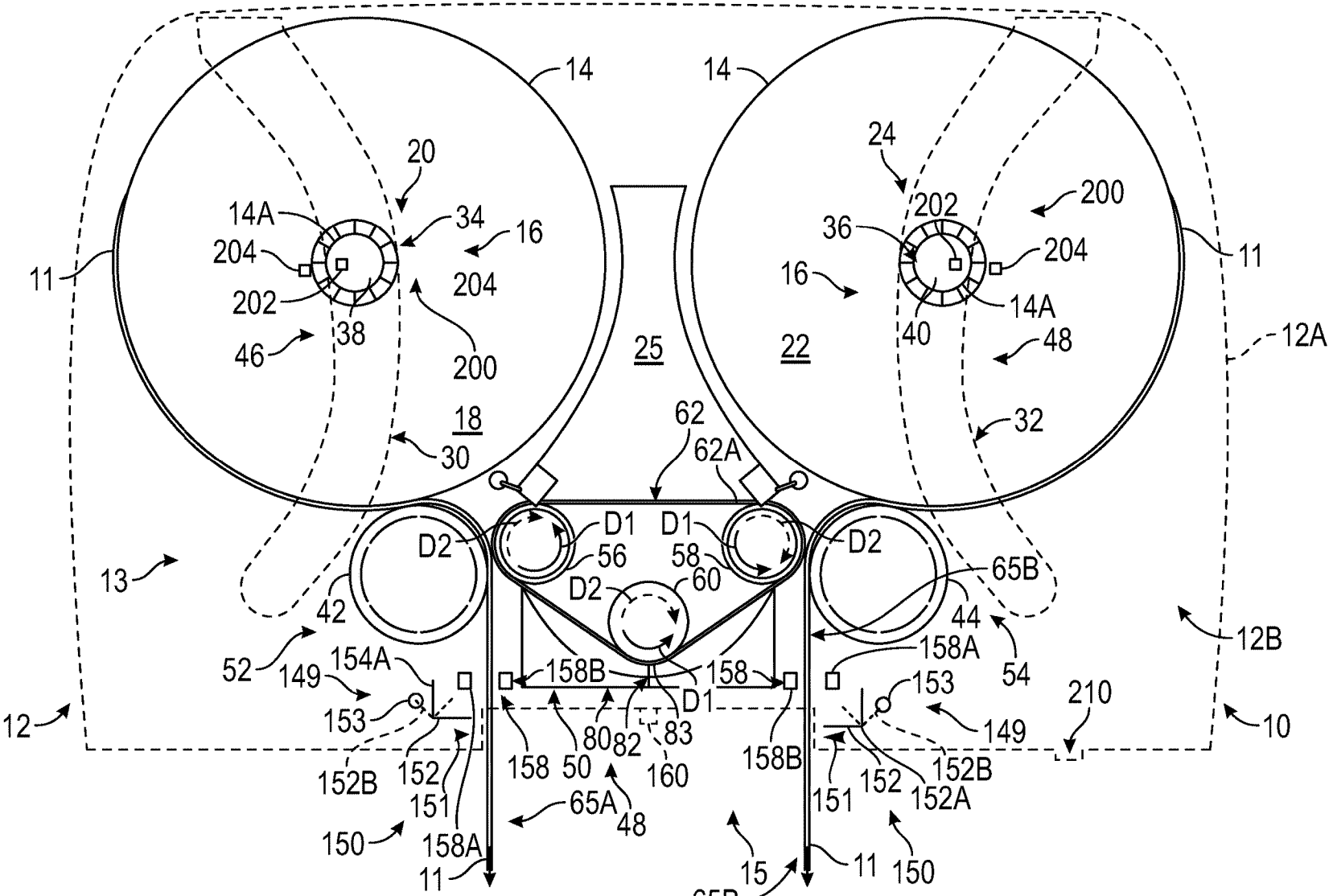
FIG. 1 provides a schematic illustration of a dispensing assembly for selectively dispensing a predetermined amount of sheet material from a plurality of supplies of sheet material according to principles of the present disclosure.

FIG. 1 shows a dispenser assembly 10 for dispensing a rolled sheet material 11, such as tissue rolls, paper towel rolls, or other suitable rolled sheet material products. As shown in FIG. 1, the dispenser assembly 10 can include a dispenser housing 12 having a cover 12A that is movable/removable to allow access to the components of the dispenser assembly 10, and a backing portion 12B that is configured to mount or otherwise connect (e.g., via fasteners, adhesive, etc.) to the dispenser assembly 10 to a wall, partition, or other suitable support within a facility, such as a restroom, hospital room, etc. The dispenser housing 12 can be formed from plastic materials, metallic materials, other suitable synthetic or composite materials, or combinations thereof. The dispenser housing 12 further includes one or more chambers or compartments 13 defined therein and sized, dimensioned, and/or configured to receive and house a plurality of supplies 14 of sheet material 11 therein. The dispenser housing 12 also including a discharge 15, e.g., including one or more apertures or openings, that facilitates dispensing of the sheet material 11 of the supplies of sheet material 14 from the dispenser assembly 10.

As generally shown in FIG. 1, each supply 14 of sheet material typically includes a roll or spindle 14A with sheet material 11 wrapped or spun thereabout. The dispenser assembly 10 further includes a plurality of support assemblies 16 rotatable supporting plurality of supplies 14 within the dispenser housing 12. That is, each supply of sheet material 14 is configured to be supported by a corresponding support assembly 16 positioned with the chamber(s) 13 of the dispenser housing 12. The plurality of supplies 14 of sheet material can include a first supply 18 of sheet material that is supported by a corresponding first support assembly 20, and a second supply 22 of sheet material that is supported by a second support assembly 24. The first and second support assemblies 20/24 can be spaced apart from each other along the dispenser housing 12 as generally indicated in FIG. 1. A partition or other suitable portion 25 further can be positioned between the first and second support assemblies 20/24.

In one construction, the support assemblies 20/24 can include slots or grooves 30/32 defined in or along the dispenser housing 12 (e.g., in the cover 12A and/or backing portion 12B or other walls, portions, supports, etc. within the dispenser housing 12). The slots 30/32 can be configured to at least partially receive first and second ends 34/36 of the support roll or spindle 38/40 for the first and second supplies 18/22 of sheet material, and at least a portion of each of the supplies of sheet material being supported by and/or resting on or engaging a corresponding guide roller 42/44. The slots or grooves of the roll support assemblies 20/24 can include one or more angled or sloped portions 46/48 having a variable slope or angle to increase and/or decrease an amount of force the supply 18/22 of rolled sheet material exerts on the guide rollers 42/44. The slope of portions 46/48 can be selected such that as the sheet material is fed from the supplies 18/22 of sheet material and is depleted (e.g., the amount and thus the weight of sheet material remaining on a roll 38/40 decreases), the position of the supply rolls 18/22 will change so as to generally maintain a substantially constant downward force exerted by the sheet material supplies 18/22 on the respective guide rollers 42/44.

Figure 2A:
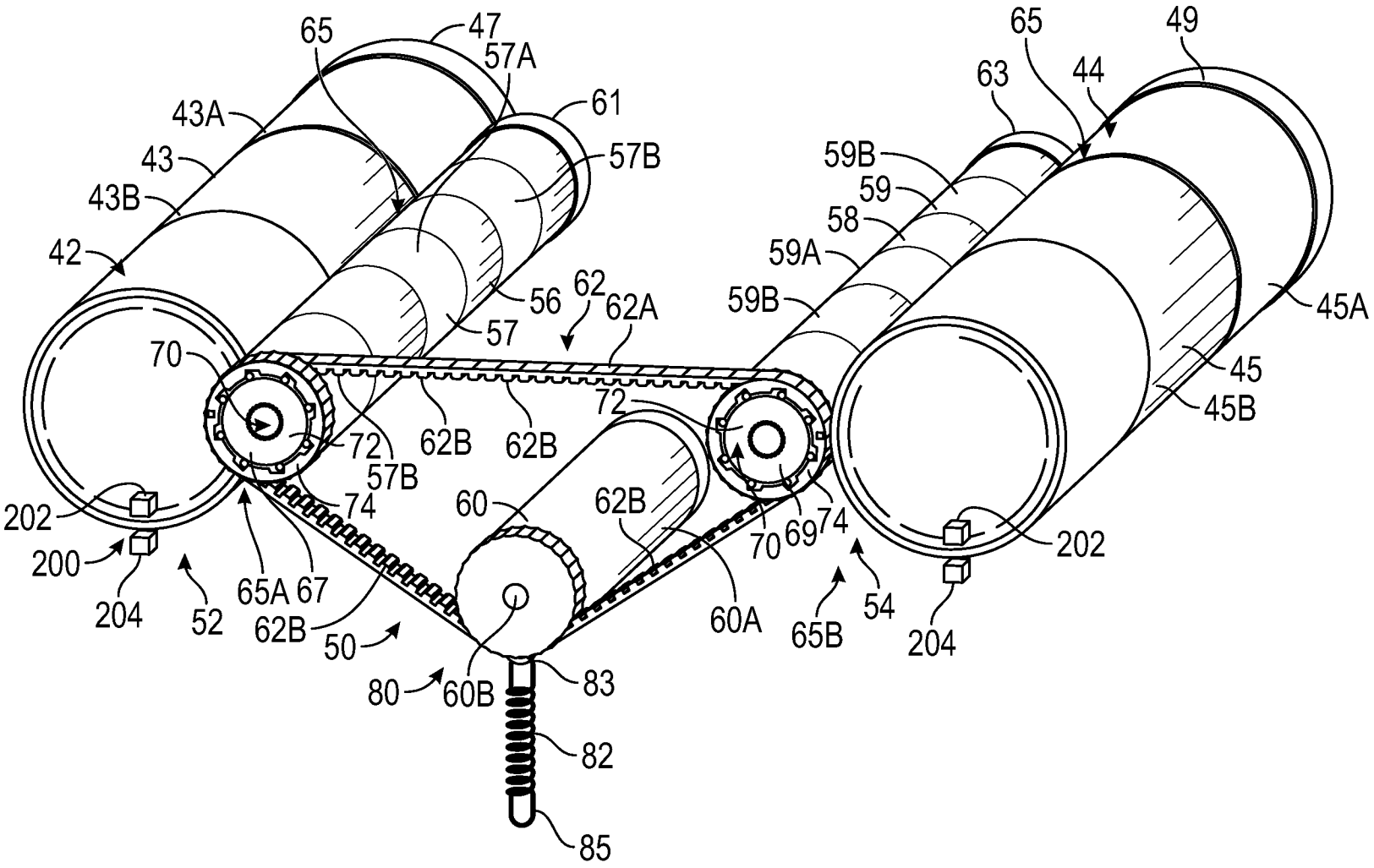
FIG. 2A shows a perspective view of a drive system for the dispensing assembly of FIG. 1.

As generally shown in FIG. 2A, the guide rollers 42/44 of the dispenser assembly 10 will be positioned along or substantially proximate, adjacent, etc. and engaging the supplies 14 of sheet material, with the first guide roller 42 engaging the first supply 18 of sheet material and the second guide roller 44 engaging the second supply 22 of sheet material. Each of the guide rollers 42/44 can include an elongated body 43/45 defining a substantially cylindrical sidewall 43A/45A configured to engage the sheet material from the supplies 18/22 of sheet material, e.g., to at least partially support the supplies 18/22 of sheet material within the slots 30/32 (FIG. 1) and to facilitate dispensing of the supplies 18/22 of sheet material from the dispenser assembly 10. The body 43/45 of the guide rollers 42/44 can be formed from a plastic material, though other materials, such as wood, elastomeric materials, such as rubber, or other composite or synthetic materials or combinations thereof, can be used without departing from the scope of the present disclosure. The guide rollers 42/44 also can include bands 43B/45B of a gripping material, e.g., including a rubber or other elastomers or synthetic materials, to assist in gripping or engaging the sheet material 11 without causing damage thereto. The guide rollers 42/44 are rotatably mounted within the dispenser housing 12. FIG. 2A shows that the guide rollers 42/44 can include bearing assemblies 47/49 attached to the guide rollers 42/44 that support the guide rollers 42/44 within the dispenser housing 12, such that the guide rollers 42/44 are rotatable thereabout (e.g., the bearing assemblies 47/49 can be fixedly connected to the backing portion 14B and/or the cover 14A or other walls, portions, supports, etc. of the dispenser assembly 12). The bearing assemblies 47/49 can include roller bearings, ball bearings, etc., or other suitable mechanisms that facilitate rotation of the guide rollers 42/44.

FIGS. 1 and 2A further show that the dispenser assembly 10 includes a dispensing system or mechanism 50 for selectively dispensing predetermined amounts (i.e., particular, selected lengths) of sheet material 11 from the plurality of supplies 18/22 of sheet material. The dispensing system 50 can include a plurality of driven rollers 56/58 for engaging and driving the sheet material from the supplies 18/22 of sheet material. For example, the first supply 18 of sheet material can be dispensed by a corresponding first driven roller 56 and the second supply 22 of rolled sheet material can be dispensed by a corresponding second driven roller 58. The first driven roller 56 will engage and draw or urge sheet material from the first supply 18 of sheet material along a first discharge path 65A toward and out of the discharge 15 of the dispenser housing 12, while the second driven roller 58 will engage and draw or urge sheet material from the second supply 22 of sheet material along a second discharge path 65B toward and out of the discharge of the dispenser housing 12.

Figure 5:
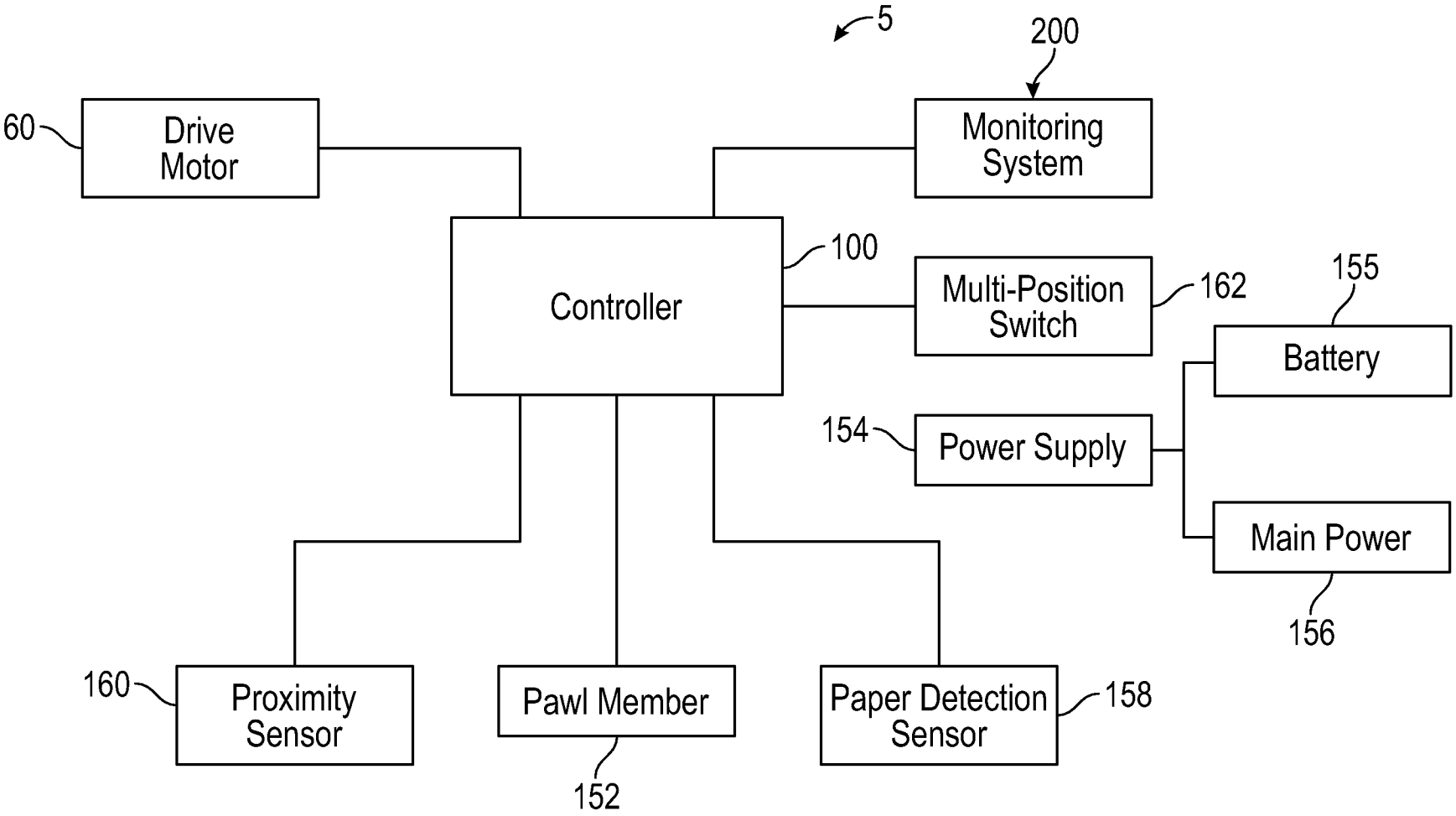
FIG. 5 shows a block diagram of an example of a control system of the dispenser assembly according to principles of the present disclosure.

As additionally indicated in FIGS. 1 and 2A, the dispenser assembly 10 includes a drive mechanism 60 operatively connected or coupled to the plurality of driven rollers 56/58 to drive rotation thereof. In one variation, the drive mechanism 60 can include a motor 60A (e.g., a brushless servo or stepper motor, or other, similar type of variable speed, reversible electric motor), though or other suitable drive mechanisms, drive systems, actuators, etc. can be used without departing from the scope of the present disclosure. The driven rollers 56/58 positioned substantially adjacent and along the guide rollers 42/44 rotate under the power of the drive mechanism 60 to pull the sheet material 11 from the respective supplies 18/22 and along the discharge paths 65A/B at least partially defined between the driven rollers 56/58 and associated guide rollers 42/44 and through the discharge 15 defined in the dispenser housing 12. Each driven roller 56/58 further is selectively driven/rotated by a drive mechanism 60 linked to or otherwise in communication with the driven rollers 56/58. The drive mechanism 60 communicates with a control circuitry 5 (e.g., including controller 100 as shown in FIG. 5) of the dispenser assembly 10 to receive instructions and power for selectively activating and driving the driven rollers 56/58 of each roller assembly through a dispensing cycle (e.g., a determined time, number of revolutions, etc.), to feed the selected or desired amount/length of the sheet material through the discharge 15 of the dispenser housing 12. In addition, the drive mechanism 60 can be driven in a first direction, e.g., D1 in FIG. 1, to drive the first driven roller 56 and move the sheet material from the corresponding first supply 18 of sheet material along the first discharge path 65A toward and out from the discharge 15 of the dispenser housing 12. The drive mechanism 60 also can be reversed and driven in a second direction, e.g., D2 in FIG. 1, to drive the second driven roller 58 and move the sheet material from the corresponding second supply 22 of sheet material along the second discharge path 65B toward and out from the discharge 15 of the dispenser housing 12.

FIG. 2A shows that the driven rollers 56/58 can include an elongated body 57/59 with a generally cylindrical sidewall 57A/59A that is configured to engage and pull the sheet material 11 from the respective supplies of sheet material 18/22. The driven rollers 56/58 are rotatably mounted within the dispenser housing 12 by one or more bearing assemblies 61/63 (e.g., including roller bearings, ball bearings, etc. or other suitable bearing mechanisms that facilitate rotation of the driven rollers 56/58) connected to the backing portion 12B and/or the cover 12A or other suitable wall, portion, support, etc. within the dispenser housing 12. The driven rollers 56/58 further can include bands of a gripping material 57B/59B, such as a rubber or synthetic material, to assist in pulling the sheet material between the driven rollers 56/58 and guide rollers 42/44, without causing damage to the sheet material as it passes between the driven 56/58 and guide 42/44 rollers.

In some constructions, the driven rollers 56/58 and/or the guide roller 42/44 can be biased into engagement with each other (e.g., by one or more biasing mechanism, such as springs, e.g., compression springs, tension springs, torsion springs, etc.; elastic cylinders; and/or other suitable biasing mechanisms) to press or otherwise engage the sheet material between the driven rollers 56/58 and guide 42/44 rollers. The roller assemblies 52/54 further can include additional guide or pressing rollers positioned adjacent the driven rollers 56/58 and/or guide rollers 42/4 and to guide or engage the sheet material without departing from the scope of the present disclosure.

In addition, the drive system 50 can include a belt driven transmission assembly 62 including a driven belt 62A operatively connecting or engaging the driven mechanism 60 and driven rollers 56/58 to transfer power therebetween for selectively driving rotation of the first driven roller 42 and/or the second driven roller 44. For example, as indicated in FIGS. 1 and 2A, the drive mechanism 60 can be operatively connected to each of the driven rollers 56/58 by a drive belt 62A that engages corresponding belt pulleys or belt gears 67/69 connected to each of the driven rollers 56/58 and a belt pulley or belt gear 71 connected to the driven mechanism 60. The belt gears 67, 69, and 71 can include a first driven roller belt gear 67 operatively connected to the first driven roller 42; a second driven roller belt gear 69 operatively connected to the second driven roller 44; and a drive mechanism belt gear 71 operatively connected to the drive mechanism 60.

In the illustrated construction, a single belt 62 is shown operatively connected to the drive mechanism 60 (e.g., engaging the belt gear 71 that is coupled to a driveshaft 60B of the motor 60A) and to each of the driven rollers 56/58 (e.g., engaging the belt gears 67/69 attached thereto or otherwise in operative communication therewith); however, a series of belts can be used to connect the drive mechanism 60 and driven roller 56/58, such as one drive belt connecting the drive mechanism 60 and driven roller 56 and another drive belt connecting the drive mechanism 60 and driven roller 58, without departing from the scope of the present disclosure. It further will be understood that in additional or alternative constructions one or more of the driven rollers 56/58 can be connected to the driven mechanism 60 by other suitable transmission assemblies or mechanisms, such as a series of gears or other suitable transmission assemblies.

Figure 2B:
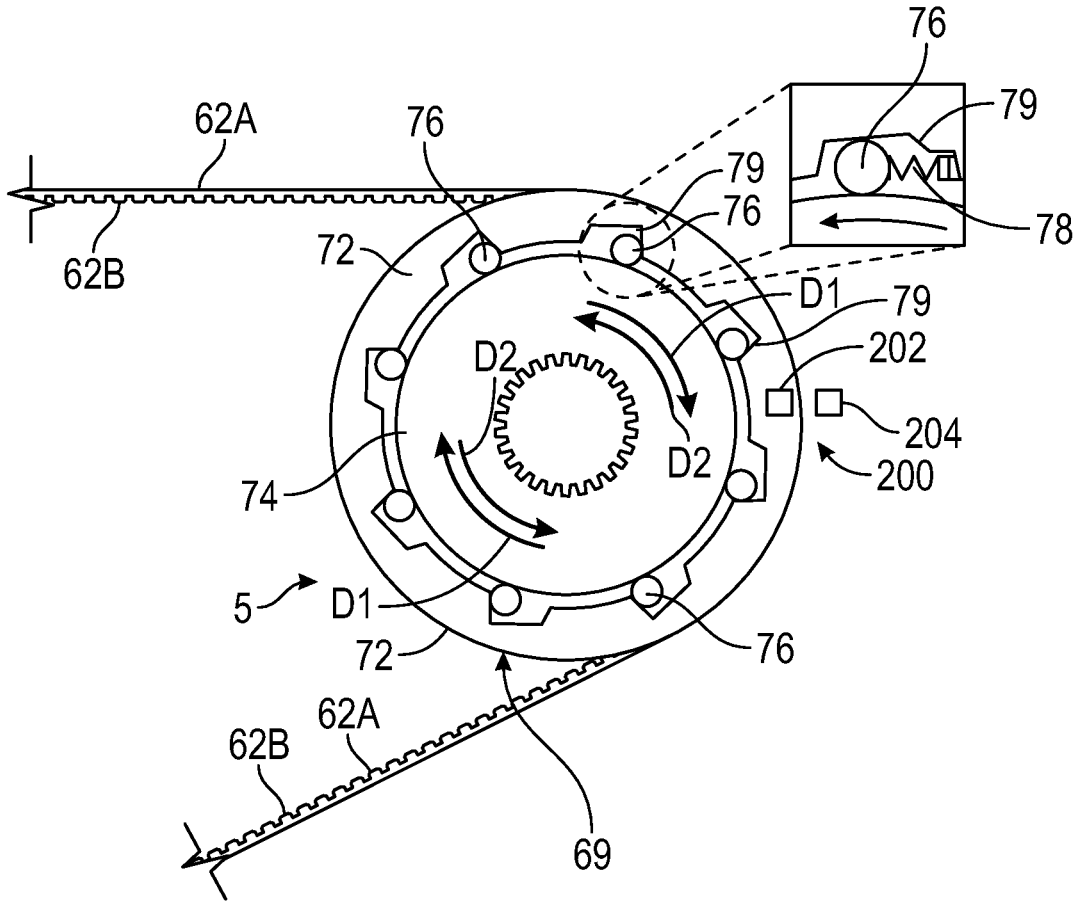
FIG. 2B shows a belt pulley of a driven roller of the drive system of FIG. 2A with an integrated clutch mechanism according to principles of the of the present disclosure.
Figure 2C:
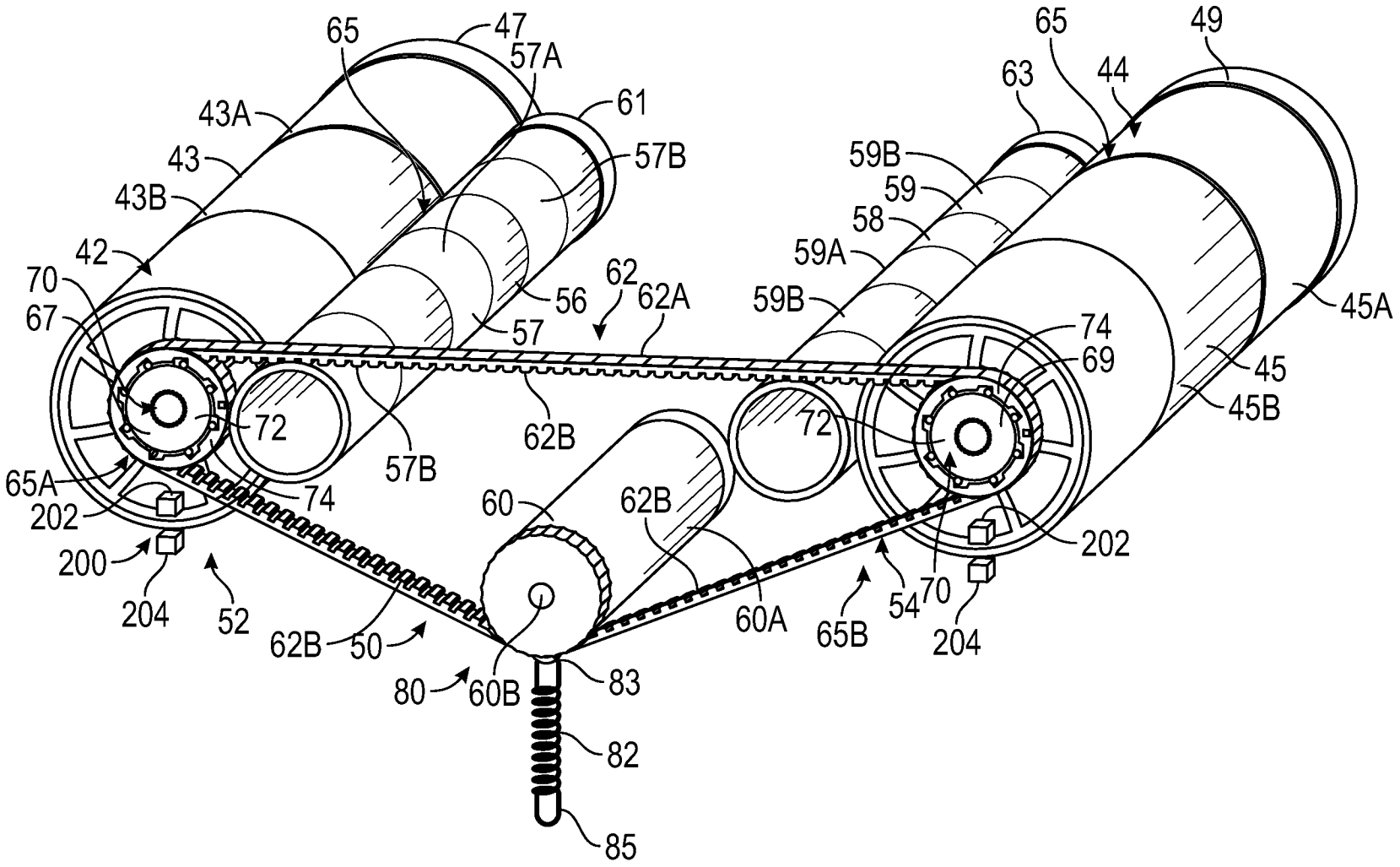
FIG. 2C illustrates a drive system according to further principles of the present disclosure.

In an additional or an alternative construction, as generally indicated in FIG. 2C, the belt gears 67/69 can be operatively connected to the rollers 42/44 (rather than rollers 56/59) such that the rollers 42/44 are driven rollers. That is, as FIG. 2C indicates, the belt 62A can engage the belt gears 67/69 attached to the ends of the driven rollers 42/44 such that the driven rollers 42/44 can be selectively driven and rotated by the drive mechanism 60. In this construction, the rollers 56/58, which are not directly engaged by the belt 62A, are allowed to float and further can be biased into engagement with the driven rolls 42/44 (e.g., by one or more biasing assemblies including at least one biasing member, such as a spring, biased cylinder, etc.). The rollers 56/58 accordingly can be configured as guide or pressing rollers to help to direct the sheet material along the respective discharge paths 65A and 65B. In additional variations, a plurality of pressing or guide rollers can be positioned along and biased into engagement with the driven rollers 42/44. Still further, the pressing or guide roller(s) (e.g., rollers 56/58) can be coupled to the rollers 42/44 by a transmission mechanism, such as a belt driven transmission mechanism, that can transfer power between the rollers 42/44 and 56/58 and also can be configured to bias the rollers 42/44 and 56/58 towards engagement with one another.

As shown in FIGS. 1-3B, the belt 62A also can include a plurality of cogs or teeth 62B disposed thereabout and configured to engage corresponding notches, teeth, etc. in the belt gears, i.e., 67, 69, and/or 71. The belt 62A and/or the cogs 62B thereof can be formed from a rubber material, such as a chloroprene rubber, or other suitable rubber, though any suitable material can be used without departing from the scope of the present disclosure. The belt 62A also can include one or more layers or plies, including a tensile layer that comprises a reinforcement, for example, fiberglass, though the belt can comprise any suitable material, e.g., other rubbers, plastics, synthetics and/or composites, without departing from the present disclosure. Additionally, the belt 62A can include a wrapping, such as a cloth or sheet material comprising high elastic nylon, though the wrap cloth can comprise any other suitable material without departing from the present disclosure.

The driven rollers 56/58 (or driven rollers 42/44 as shown in FIG. 2C) generally are configured to be selectively rotatable to dispense amounts of sheet material 11 from their corresponding supply of sheet material 18 or 22 when driven in one direction by the drive mechanism 60, but generally will remain substantially stationary, such that sheet material 11 is not dispensed from its corresponding supply of sheet material 18 or 22, when the drive mechanism 60 is driven in the opposite direction. For example, when the first driven roller 56 is rotated by the drive mechanism 60 in a first direction D1 shown in FIG. 1, the first driven roller 56 can engage and feed/dispense sheet material from the first supply 18 of sheet material, while the second driven roller 58 remains generally stationary such that sheet material from the second supply 22 is not dispensed therefrom. When the drive mechanism 60 is driven in a second, opposite direction D2 shown in FIG. 1, the second drive roller 58 will be rotated to dispense the select/predetermined amounts of sheet material from the second supply 22 of sheet material while the first driven roller 56 remains generally stationary, such that the sheet material is not dispensed from the first supply 18 of rolled sheet material. Accordingly, the dispenser assembly 10 can provide for selective dispensing of the plurality of supplies 18 or 22 of sheet material by controlling the driving direction of the drive mechanism 60. Thus, sheet material 11 can be dispensed from one supply of sheet material 18 or 22, until such supply is substantially dispensed or exhausted, after which the direction of the drive mechanism 60 can be switched/changed (e.g., reversed or otherwise altered) to transfer to and begin dispensing the sheet material 11 from the other supply of sheet material 18 or 22.

The driven rollers 56/58 (or driven rollers 42/44 as shown in FIG. 2C) also can include or incorporate a clutch assembly or mechanism 70, such as a hybrid or one-way clutch mechanism, that allows for selective transfer of power between the drive mechanism 60 and the driven rollers 56/58 (or driven rollers 42/44 as shown in FIG. 2C), such as generally shown in FIGS. 2A and 2B. For example, as FIGS. 2A-2C indicate, the clutch assembly 70 can be incorporated or integrated with the belt gears 67/69 connected to the driven rollers 56/58 (or rollers 42/44 as shown in FIG. 2C). Accordingly, when the drive mechanism 60 is driven in a first direction D1, the clutch assembly 70 of the first driven roller 56 will lock/engage for transfer of power/torque to the first driven roller 56 so that the first driven roller 56 is driven by the drive mechanism 60 and rotated to dispense its corresponding supply 18 of sheet material (while the clutch assembly 70 of the second driven roller 58 remains generally disengaged such that the second driven roller 58 is substantially stationary as no power/torque is transferred from the drive mechanism 60 and the second driven roller 58). In addition, when the drive mechanism 60 is driven in the opposite direction D2, the clutch assembly 70 for the first driven roller 56 will unlock or disengage such that there is no transfer of power/torque between the drive mechanism 60 and the first driven roller 56 such that the first driven roller 56 remains generally stationary (while the clutch assembly 70 for the second driven roller 58 engages or locks for transfer of power/torque to the second driven roller 58 so that the second driven roller 58 is rotated to dispense its corresponding supply 22 of sheet material).

In one example construction, as generally indicated in FIG. 2B, each clutch assembly 70 can include one or more tracks/races, such as inner and outer races 72/74, that rotate together (when engaged) or independently of one another (when disengaged). The clutch assembly 70 further can include a plurality of biased rollers or bearings 76 can be received between the inner and outer races, and can be biased such as by a series of springs 78 or other biasing mechanisms, toward/against corresponding surfaces or other engagement portions 79 of the outer race 74 to stop or prevent rotation of the bearings 76, and provide engagement or coupling between the inner 72 and outer 74 races. For example, as indicated in FIG. 2B, when the inner race 72 is rotated in the direction D1 shown in FIG. 2B upon rotation of the driven mechanism 60, the bearings 76 are engaged and urged into the surfaces 79, which blocks or prevents rotation of the rollers 76, allowing the inner race 72 to engage, drive, and rotate the outer race 74 and thus rotate the driven roller 58 to facilitate feeding of sheet material from its corresponding supply 22. And, when the inner race 72 is rotated in the opposite direction D2 shown in FIG. 2B, the rollers 76 move away from and do not engage the outer race 74 (e.g., do not engage the engagement portions 79) under the control of the springs 78, such that the rollers 76 can rotate or spin freely allowing the inner race 72 to turn independently of the outer race 74, such that the driven roller 58 does not rotate and remains generally stationary.

The dispenser assembly 10 further can include a tensioning assembly 80 including one or more biasing members 82. For example, as shown in FIGS. 1, 2A, and 3A-B, the one or more biasing members 82 can be operatively connected to the drive mechanism 60 for biasing the drive mechanism 60, such as to provide tension along the drive belt 62A (e.g., to substantially prevent, reduce, or inhibit wear, slippage, etc. thereof) and/or to provide dampening for the drive mechanism 60 (e.g., dampening or absorbing motor vibrations or other components of the drive system). In one example, the biasing member(s) 82 can include a tension spring(s) 82A with one end 83 thereof operatively connected to the drive mechanism 60 (or part/component connected to the drive mechanism 60 or a bracket, support, frame, etc. supporting the drive mechanism within the dispenser housing 12) and another end thereof 85 operatively connected to a portion of the dispenser housing 12.

Figure 3A:
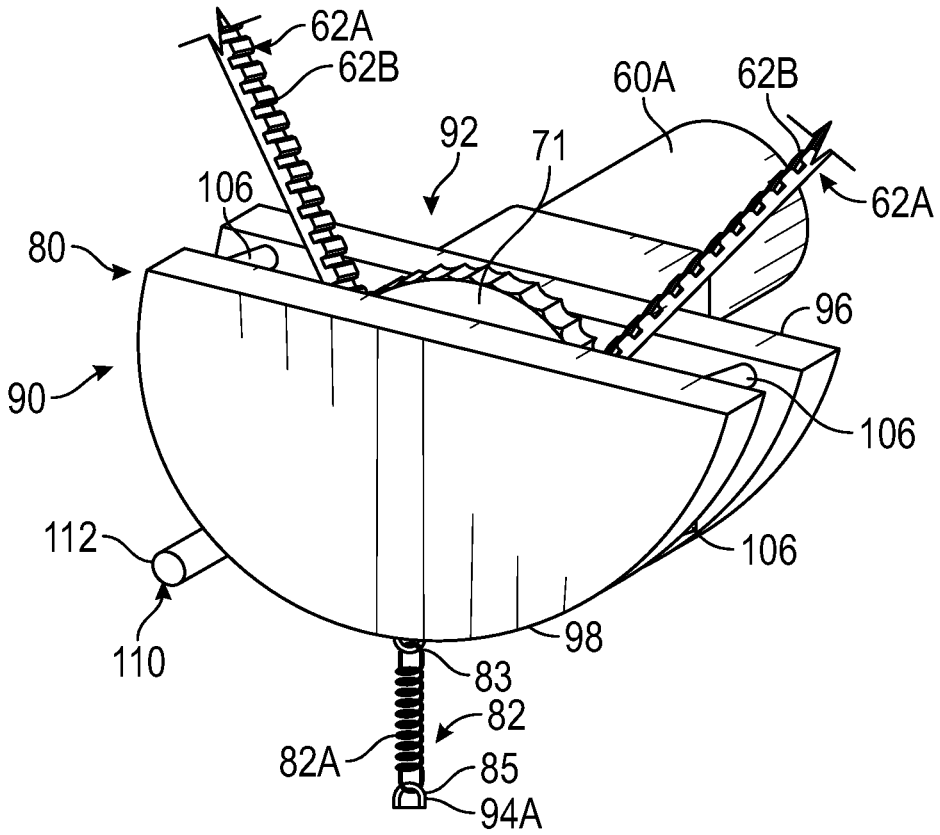
FIGS. 3A-3B illustrate examples of a cutting mechanism and pawl member according to example constructions of the present disclosure.
Figure 3B:
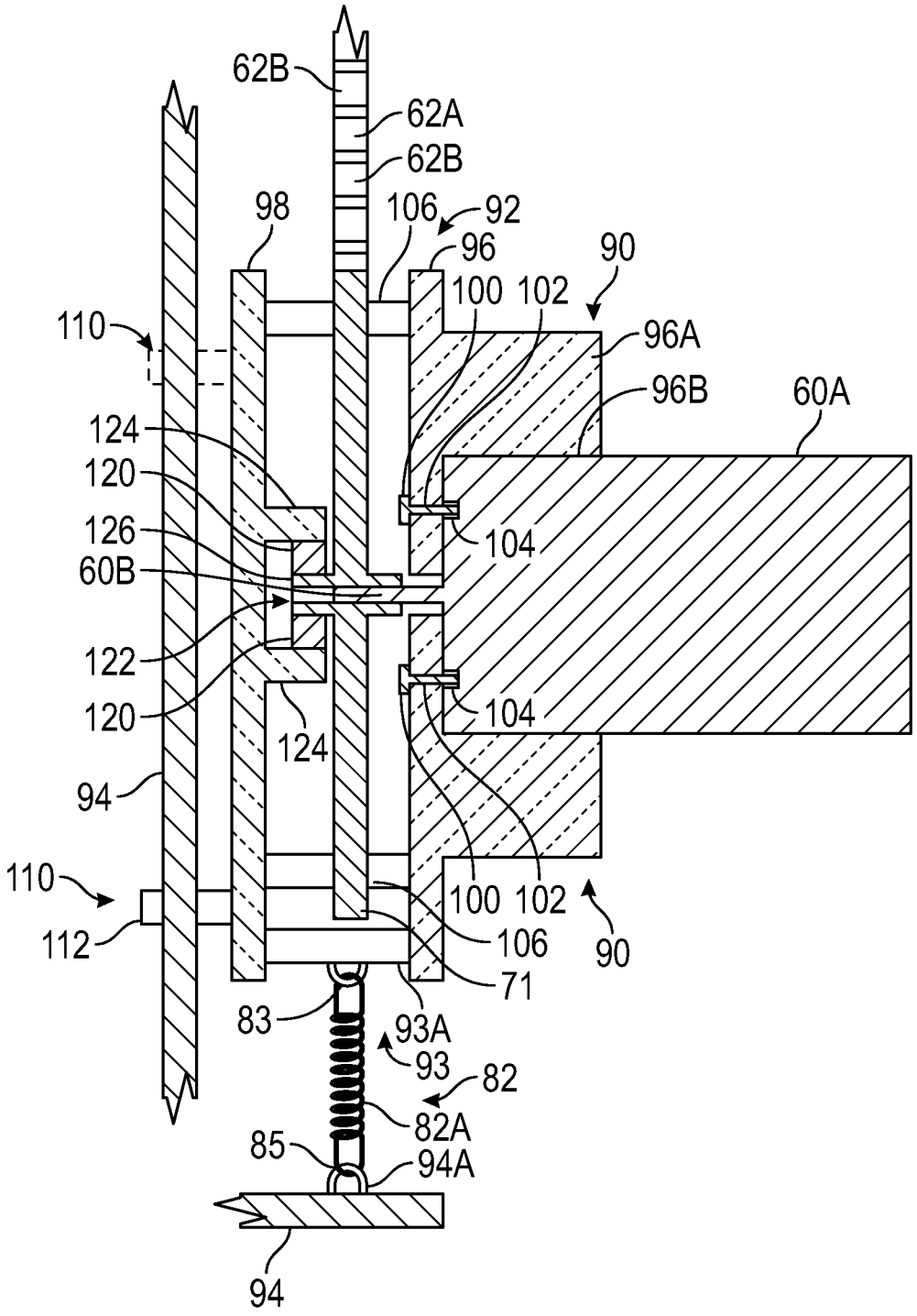

FIGS. 3A and 3B illustrate perspective and cross-sectional views of a tensioning assembly 80 according to one example construction of the present disclosure. As indicated in FIGS. 3A and 3B, the tensioning assembly 80 can include a support assembly 90 including a bracket 92 that is connected to and supports the drive mechanism 60 (i.e., the motor 60A and the belt gear 71 attached thereto) and that is movably connected to the dispenser housing 12 (e.g., movably connected to a wall, support, etc. 94 of, or otherwise connected to, the dispenser housing 12 (FIG. 3B). The bracket 92 further includes one or more connection mechanisms 93 that are configured to connect to the biasing member(s) 82. That is, one hooked, or looped end 83 of the biasing member(s) 82 can be connected to the connection mechanism 93 (e.g., including a rod 93A or other suitable connection mechanism, such as a hooked or looped connection mechanism), and the opposite, hooked or looped end 85 of the biasing member 82 can be operatively connected to a wall, support or other suitable portion 94 of the dispenser housing 12 (e.g., via a hooked or looped connection mechanism 94A or other suitable connection mechanism, such as a rod, projecting portion, etc.). Accordingly, the tensioning assembly 80 provide tension, e.g., a tensile force or stresses, along the drive belt 62A (e.g., to substantially prevent, reduce, or inhibit slippage, premature wear, etc. thereof) and also to provide dampening for the dispenser assembly 10 during operation thereof (e.g., to dampen or absorb vibrations of the motor 60A, or other components of the drive assembly, such as to reduce noise generated thereby).

The bracket 92 can include a first portion or section 96 that is connected to the motor 60A, and a second portion or section 98 that is movably connected to the wall 94 of the dispenser housing 12. The first portion 96 of the bracket 92 can be connected to the motor 60A by one or more fasteners 100, such as screws, bolts, etc. For example, the fasteners 100 can be received through holes 102 (e.g., threaded or unthreaded holes) defined through the first portion 96 and can also be tightened into or otherwise received in corresponding threaded holes 104 of the motor 60A to secure the motor 60A to the first portion 96. The first portion 96 further can include a flange or projecting portion 96A that defined a passage or opening 96B that is sized, dimensioned, and/or configured for receipt of the motor 60A, e.g., to facilitate a frictional or snap fitting between the motor 60A and the first portion 96.

The first portion 96 further can be connected to the second portion 98 by support rods or posts 106, one or more of which can be integrally formed with the first 96 and/or second 98 portions, as generally shown in FIGS. 3A and 3B. The support rods 106 further include a passage or opening defined therethrough, which can include threads or be unthreaded and allow for the receipt of a fastener, such as a bolt, screw, etc., that can be received through corresponding holes in the first 96 and/or second 98 portions to facilitate attachment of the first 96 and/or second 98 portions. The support rods 106 can be otherwise attached to the first 96 and/or second 98 portions, such as using an adhesive, frictional or fitted connection, etc., without departing from the scope of the present disclosure.

As additionally indicated in FIGS. 3A and 3B, the tensioning assembly 80 can include a movable connection mechanism 110 that movably connects the second portion 98 to a wall 94 of the dispenser housing 12, i.e., such that the bracket 92 can move under the guidance or control of the biasing member(s) 82. In one construction, the moveable connection mechanism 110 can include a bearing assembly 112 that is rotatably or pivotally connected to the wall 94 of the dispenser housing 12. The bearing assembly 112 can include one or more roller bearings or other suitable bearings, bushings, or mechanisms that allow for pivoting or rotation of the bracket about the bearing assembly 112. In an alternative construction, the connection mechanism 110 can include a plurality of fasteners, such as screws, bolts, etc., and the second portion 98 of the bracket 92 can be connected to the wall 94 by the plurality of fasteners, which can be received within slots or other elongated apertures defined in the wall 94 to allow for sliding movement of the bracket 92 under the guidance or control of the biasing member(s) 82.

FIGS. 3A and 3B further show that the second portion 98 of the bracket 92 can at least partially support the belt gear 71 connected to the driveshaft 60B of the motor 60A, as well as the driveshaft 60B, itself. For example, the tensioning assembly 80 can include a belt gear bearing assembly 120 (e.g., including ball bearings, roller bearings, etc.) that is at least partially received within and engages an opening or passage 122 defined within a flange or projecting portion 124 of the second portion 98 of the bracket 92 (i.e., such that the bearing assembly 120 is supported thereby), and that also engages the belt gear 71. For example, the bearing assembly 120 engages a flange or other projecting portion 126 formed with the belt gear 71 (e.g., the flange 126 is at least partially fitted into or otherwise received within a passage 128 of the bearing assembly 120). Accordingly, the bracket 92 at least partially supports the belt gear 71 and/or driveshaft 60B of the motor 60A, e.g., such that the motor 60A and belt gear 71 move as a substantially unitary structure to help to reduce, inhibit, or prevent bending, twisting, or other unwanted movement of the driveshaft 60A and/or belt gear 71 due to the urging of the biasing member 82 and/or operation of the dispenser assembly 10. This further can help to reduce or inhibit premature and/or uneven wear or other damage to the motor 60A, belt gear 71, and/or other components of the drive assembly or dispenser assembly.

Figure 4A:
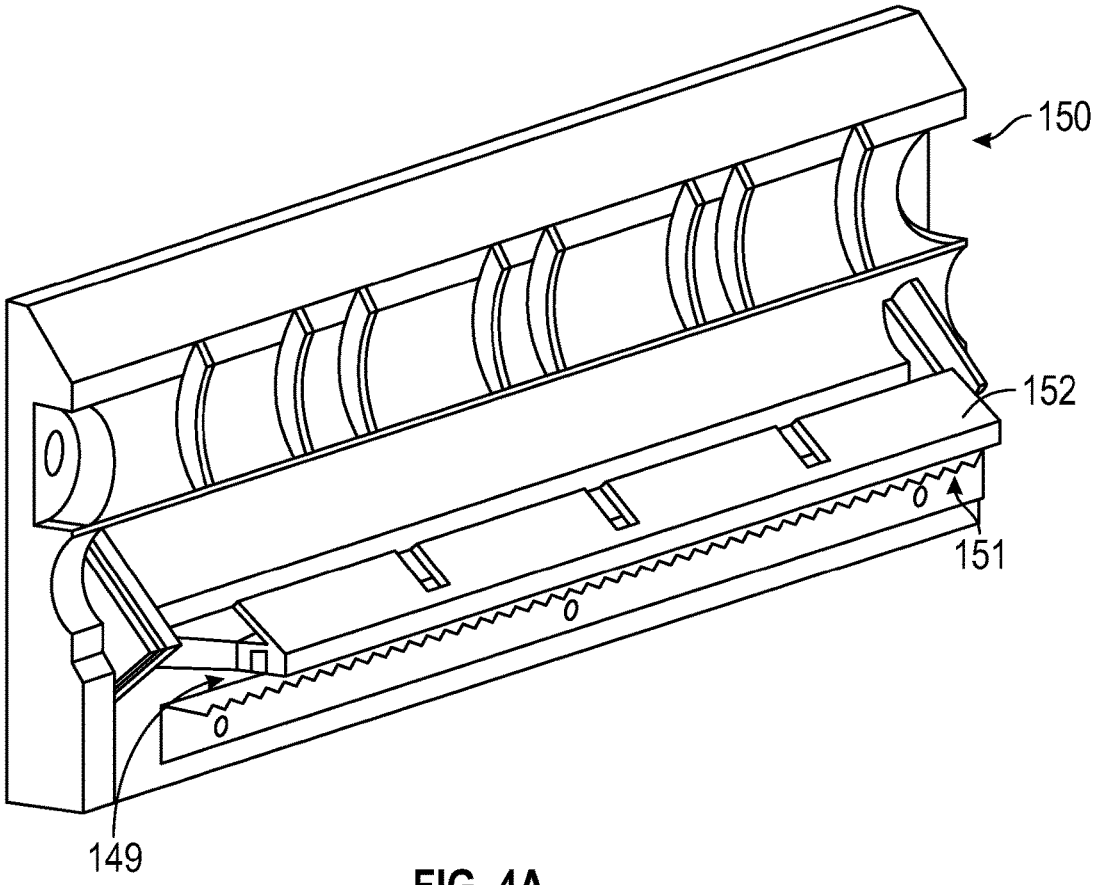
FIGS. 4A-4B show perspective and cross-sectional views of a tensioning assembly according to principles of the present disclosure.
Figure 4B:
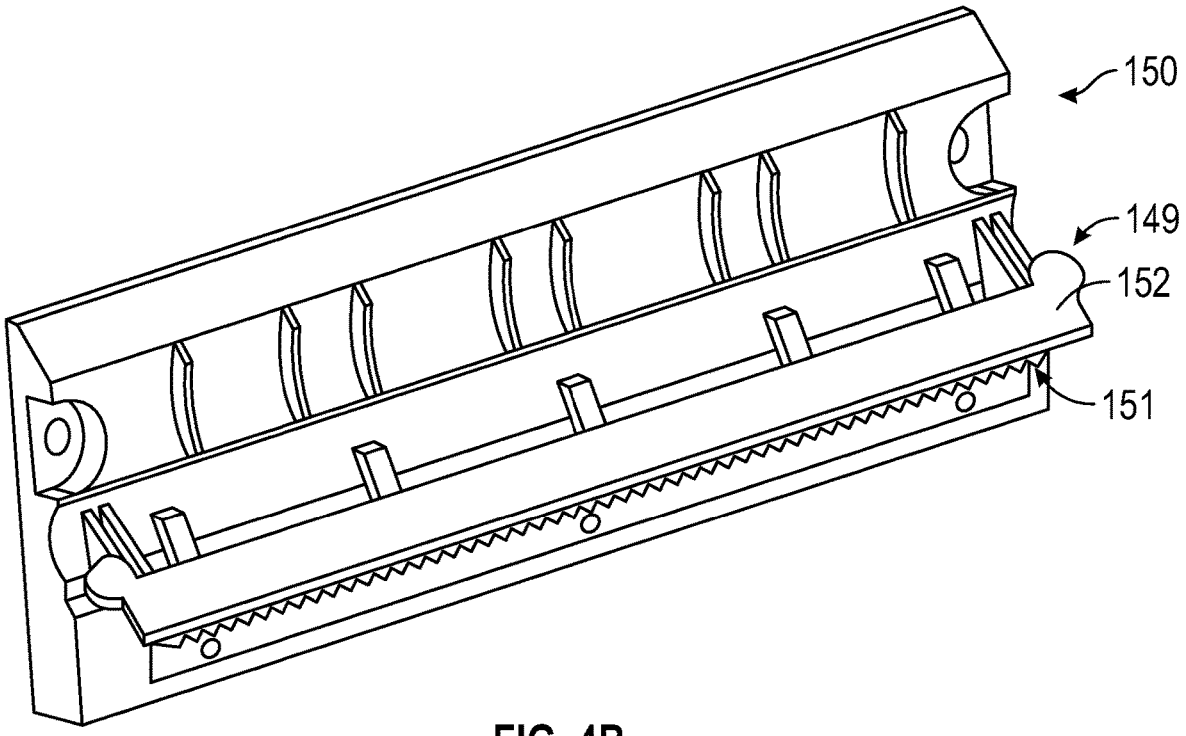

The dispenser assembly 10 also can include a cutting mechanism/assembly 150 for cutting or severance of dispensed sheet material. In one construction, as shown in FIGS. 1, 4A, and 4B, the dispenser housing may include one or more tear bars or other suitable cutting members 151 disposed adjacent or along the discharge 15 of the dispenser housing 12 so that a user can separate a sheet or measured amount of the material by grasping and pulling the sheet across the tear bar 151. In addition, or in alternative constructions, the dispenser assembly 10 can include one or more cutting mechanisms that are incorporated with the guide rollers 42/44 and/or the driven rollers 56/58 and are configured to move with rotation thereof to cut, sever, and/or perforated the sheet material 11 as or after it is dispensed from the supplies 18 or 22 of sheet material.

As additionally shown in FIGS. 1, 4A, and 4B, the dispenser assembly 10 can include a pawl member assembly 149 including a pivotally mounted pawl member 152 that is located proximate to the tear bar 151 such that movement of sheet material into the tear bar 151 for severance pivots the pawl member 152 between multiple positions 152A/152B. The pawl member assembly 149 also includes a signal device 153, such as a proximity sensor switch or the like, cooperative with the pawl member 152, that is arranged such that movement of the pawl member 152 between various positions causes the signal device 153 to send a signal to notify the control circuit or controller 5 that the sheet material has been removed. That is, movement of the sheet material into the cutting mechanism 150 generally will move the pawl member 152 from a first position 152A to a second position 152B, which activates the signal device to transmit one or more signals to the control circuitry 5 to notify the control circuit 5 that a portion of the dispensed sheet material has been removed. By way of example, such signal device 153 responsive or cooperative with the pawl member 152 can include an infrared emitter and detector that detects movement of the pawl member 152 between first 152A and second 152B positions, though any suitable sensor or detection mechanism can be employed such as a proximity sensor or other detector, a magnetic switch, or a mechanical switch.

After receiving a signal that sheet material may have been removed, the control circuitry 5 further can activate a sheet material detection sensor 158 (FIGS. 1 and 5) to verify that the sheet material has been removed from the discharge 15. The sheet material detection sensor 158 can include an emitter 158A/B and a detector 158A/B on opposing sides of and focused across at least a portion of one or more of the discharge paths 65A/B. One or more signals transmitted from the sheet material detection sensor 158 can indicate that sheet material is present or absent from the discharge path 65A/B or discharge 15 (e.g., indicating that sheet material has been removed by a user). The sheet material detection sensor 158 further can be activated by the control circuitry 5 of the dispenser assembly 10 to verify that sheet material has been removed from the discharge 15. Examples of pawl members and sheet material detection sensors are shown and described in U.S. patent application Ser. No. 13/155,528, the disclosure of which is incorporated herein by reference as if set forth in its entirety.

The control circuitry 5 can change the driving direction of the driving mechanism 60 based on signals received from the pawl member assembly 149 and/or the sheet material detection sensor 158, e.g., to reverse the motor 60A and alternate dispensing between the supplies 18/22 of sheet material. For example, if the control circuitry 5 receives one or more signals from the signal detection device 153 and/or the sheet material detection sensor 158 that indicate that sheet material cannot be dispensed from one of the supplies 18 or 22 of sheet material (e.g., indicating an error condition, sheet material jam, etc. or that the sheet material has been exhausted from the supply 18 or 22), the control circuitry 5 can generate and transmit one or more signals to the drive mechanism 60 to change the driving direction thereof to dispense from the other supply 18 or 22 of sheet material. In addition, signals received from the signal device 153 and/or the sheet material detection sensor 158 can be used by the control circuitry 5 to calculate, estimate, or otherwise determine a supply level or amount of sheet material remain in the supplies 18 or 22 of sheet material. In one example, the control circuitry 5 can determine the supply level based on the number of times signals are received from the signal device 153 and/or the sheet material detection sensor 158 (e.g., the original amount of sheet material, the lengths of sheet material being dispensed, and the number of activation times for the pawl member 152 and/or sheet material detection sensor 158 can be used to determine the remaining amount of sheet material in the supply). And, when the supply level is at or below a threshold level, e.g., 0%, 5%, 15%, etc., the control circuitry 5 can generate one or more signals to change the direction of the motor 60A and dispense the sheet material from the other supply. The control circuitry 5 further can generate and transmit one or more alerts, alarms, notifications, if/when the control circuitry 5 determines that one or both of the supplies 18/22 are below a threshold level, e.g., 0%, 5%, 15%, 30%, etc., and/or one or more signals received from the signal device 153 and/or the sheet material detection sensor 158 indicate an error condition, sheet material jam, etc.

The dispenser assembly 10 further can include a monitoring system 200 in communication with the control circuitry 5 (e.g., with the controller 100 thereof as shown in FIG. 5) and configured to determine a supply level or remaining amount of sheet material of the supplies 18/22 of sheet material. In response to such information/determination, the control circuitry 5 can initiate or change the direction of the motor, e.g., when an amount of remaining sheet material is less than a threshold volume. In one construction, as generally indicated in FIG. 1, the monitoring system 200 can include magnets 202 connected to the support rolls 38/40 of the first and second supplies 18/22 of sheet material supply, with the magnets 202 being rotatable therewith during dispensing thereof. In one construction, as indicated in FIG. 1, the monitoring system 200 can include a single magnet 202 connected to the support rolls 38/40; however, a plurality of magnets, e.g., a ring of magnets with alternating polarities, can be arranged along the support rolls 38/40, without departing from the scope of the present disclosure. In addition, or in alternative constructions, the monitoring system 200 can include a magnet 202 or magnets connected to the guide rollers 42/44 (FIG. 2A) and/or the driven rollers 56/58 (FIG. 2B).

In addition, as shown in FIGS. 1 and 2A-2B, the monitoring system 200 can include a sensor 204 arranged substantially proximal or adjacent each magnet 202 or plurality of magnets. The sensor 204 can include a reed switch, a hall element, proximity sensor, or other suitable sensor operable to measure or otherwise capture variations, fluctuations or other changes in a magnetic field generated as each corresponding magnet 202, or plurality of magnets, is rotated with the supplies 18/22 of sheet material, guide rollers 42/44, and/or driven rollers 56/58 during dispensing and passes by the corresponding sensor 202. The detected variations, fluctuations or changes of the magnetic field can be correlated to number of rotations of the supplies of sheet material 18/22, guide rollers 42/44, and/or driven rollers 56/58, and/or a rotation angle of the supplies of sheet material 18/22, guide rollers 42/44, and/or driven rollers 56/58 for dispensing a desired length of the sheet material during each dispensing operation. By substantially continuously monitoring the number of rotations of the supplies of sheet material 18/22, guide rollers 42/44, driven rollers 56/58, and/or the number of rotations the driving mechanism 60 during dispensing operations, a diameter of the supplies 18/22 of sheet material can be substantially dynamically or continuously determined during or following each dispensing operation (e.g., the diameters can be determined during or after each dispensing operation) and, based on this determined/monitored diameter, an amount of sheet material remaining likewise can be dynamically determined, e.g., by the controller 100 of the control circuitry 5 based on signals received from the monitoring system 200. Additionally, other sensing devices or mechanisms, such as encoders or other detectors that can monitor and provide a measurement of the number of rotations of the supplies of sheet material 18/22, guide rollers 42/44, driven rollers 56/58, and/or drive mechanism 60 can be used, without departing from the scope of the present disclosure. One example monitoring system is described in U.S. patent application Ser. No. 15/922,157 which is incorporated by reference herein as if set forth in its entirety.

Furthermore, when the processor 100 of the control circuitry 5 determines that the supply level of one of the supplies 18 or 22 is at or below a threshold level, e.g., 0%, 5%, 15%, etc., based on one or more signals received from the monitoring system 200, the control circuitry 5 can generate one or more signals to change the direction of the motor 60A and dispense the sheet material from the other supply 18 or 22. In particular, upon a determination that the supply level of the first supply 18 of sheet material is below a threshold level, the direction of the drive mechanism can be changed from the first direction D1 in FIG. 1 to the second direction D2 in FIG. 1 to dispense the sheet material 11 from the second supply 22 of sheet material. Likewise, upon a determination that the supply level of the second supply 22 of sheet material is below a threshold level, the direction of the drive mechanism 60 can be changed from the second direction D2 in FIG. 1 to the first direction D1 in FIG. 1 to dispense the sheet material 11 from the first supply 22 of sheet material. The control circuit 5 further can generate and transmit one or more alerts, alarms, notifications, if/when the control circuit 5 determines that the supply level of one or both of the supplies 18/22 is below a threshold level, e.g., 0%, 5%, 15%, 30%, 40%, etc.

In addition, or in the alternative, a switch 210 disposed along the dispenser housing 12 can be manually activated by a system operator to change the direction of the dispensing mechanism 60, e.g., between directions D1 and D2 shown in FIG. 1; though the direction can be changed using any suitable means, e.g., an electronic device, e.g., computer, smart phone, tablet, etc., manage by a system operator can be used to change the direction of the drive mechanism 60. For example, the control circuitry 5 can include one or more receivers/transmitters configured to communication with the electronic device, and the control circuitry 5 can change the direction of the drive mechanism based on one or more signals received from the electronic device.

FIG. 5 illustrates a block diagram of the electronic control system or control circuitry 5 for operating the dispenser assembly 10 in an exemplary embodiment. The control circuitry generally includes a controller 100 that can include one or more processors (e.g., microprocessors) and one or more memories (e.g., RAM, ROM, etc.). One or more of the memories can store instructions, workflows, control software, etc. that are accessed and executed by the processor for carrying out operations or functions of the dispenser assembly 10. The dispenser or operative components of the dispenser may be powered by a power supply 154 such as one or more batteries 155 contained in a battery compartment of the dispenser housing 12, though any suitable battery storage device may be used for this purpose. Alternatively, or in addition to battery power, the dispenser may also be powered by a building's alternating current (AC) distribution system as indicated at 156. For this purpose, a plug-in modular transformer/adapter could be provided with the dispenser assembly 12, which connects to a terminal or power jack port located, for example, in the bottom edge of the circuit housing for delivering power to the control circuitry and associated components. The control circuitry 5 also may include a mechanical or electrical switch that can isolate the battery circuit upon connecting the AC adapter in order to protect and preserve the batteries.

In one example, a sensor, such as a proximity detector or other sensor 160, may be configured to detect an object placed in a detection zone external to the dispenser assembly 10 to initiate operation thereof. This sensor 160 may be a passive sensor that detects changes in ambient conditions, such as ambient light, capacitance changes caused by an object in a detection zone, and so forth. In an alternate embodiment, the sensor 160 may be an active device and include an active transmitter and associated receiver, such as one or more infrared (IR) transmitters and an IR receiver. The transmitter transmits an active signal in a transmission cone corresponding to the detection zone, and the receiver detects a threshold amount of the active signal reflected from an object placed into the detection zone. The control circuitry 5 generally will be configured to be responsive to the sensor for initiating a dispense cycle upon a valid detection signal from the receiver. For example, the proximity sensor 160 or other detector can be used to detect the presence of a user's hand. In some variations, the sheet material detector sensor 158 also can be aligned to detect a user's hand below the dispenser assembly 10 and can include a second infrared emitter/detector pair aligned to detect a sheet hanging in or below the discharge 15.

The controller 100 of the control circuitry can control activation of the dispensing mechanism upon valid detection of a user's hand for dispensing a measured length of the sheet material. In one variation, the control circuitry 5 can track the running time of the motor 60A, and/or receive feedback information directly therefrom indicative of a number of revolutions of the driven roller and correspondingly, an amount of the sheet material feed thereby. In addition, or as a further alternative, as discussed, monitoring systems, sensors, etc., and associated circuitry may be provided for this purpose. Various types of sensors can include IR, radio frequency (RF), capacitive or other suitable sensors, and any one or a combination of such sensing systems can be used. The control circuitry 5 also can control the length of sheet material dispensed. Any number of optical or mechanical devices may be used in this regard, such as, for example, an optical encoder may be used to count the revolutions of the guide or driven rollers, with this count being used by the control circuitry 5 to meter the desired length of the sheet material to be dispensed.

The processing logic for operation of the dispenser assembly 100 in, for example, hand sensor and butler modes, can be part of the control software stored in the memory of the controller 100 of the control system 5. One or more binary flags are also stored in memory and represent an operational state of the dispenser (e.g., "sheet material cut" set or cleared). An operational mode switch in dispenser sets the mode of operation. In the hand sensor mode, the proximity (or hand) sensor 160 detects the presence of a user's hand below the dispenser housing 12 and in response, the drive mechanism 60 is operated to dispense a measured amount of sheet material from one of the supplies 18 or 22. The control circuitry 5 then can monitor when the sheet of material is removed. For example, actuation of the pawl member 152 or triggering/activation of a sheet material detection sensor 158 can determine the removal of sheet material and reset the proximity sensor 160. The proximity sensor 160 also can be controlled to not allow additional sheet material to be dispensed until the proximity sensor is reset. If the proximity sensor 160 detects the presence of a user's hand but does not dispense sheet material, the control circuit can check for sheet material using the sheet material detection sensor 158. If sheet material has not been dispensed (i.e., no sheet material is hanging from the dispenser), the drive mechanism 60 will be activated to dispense a next sheet.

A multi-position switch 162 also can be provided to switch the dispenser operation between a first or standard operation mode and a second mode, such as a butler mode. In such butler mode, the proximity sensor 160 for detecting the presence of a user's hand/object can be deactivated, and the controller 100 can automatically dispense sheet material when the cover is closed and the dispenser assembly 10 is put into operation. The sheet material detection sensor 158 further can determine if a sheet is hanging from the dispenser. If sheet material is hanging, the controller 100 will then monitor when the sheet of material is removed. For example, a cutting mechanism movement detector, which may arranged and configured to detect actuation or movement of the cutting mechanism; the pawl member 152; and/or the sheet material detection sensor 158 can determine the removal of sheet material and reset the dispenser assembly 10. The next sheet will be dispensed automatically. If the sheet material detection sensor 158 determines the absence of hanging sheet material, the drive mechanism 60 will be activated to dispense the next sheet. The controller 100 will then determine if the sheet has been removed before dispensing another sheet.

In one variation, the dispenser assembly 10 is operative in a first mode to be responsive to a signal from the proximity sensor 160 to dispense a sheet of material. The dispenser assembly 10 is operative in a second mode to dispense a next sheet in response to the signal means being activated by movement of the pawl member 152 in response to dispensed sheet material being removed from the dispenser assembly 10. In another variation, the dispenser assembly 10 can be operative in a second mode to dispense a next sheet in response to the signal means 153 being activated by movement of the pawl member 152, and a signal from a sheet material detection sensor 158 that the sheet material has been removed from the dispenser assembly 10.

The dispenser assembly 10 generally can dispense a measured length of the sheet material, which may be accomplished by various means, such as a timing circuit that actuates and stops the operation of the motor 60A driving the driven rollers 56/58 after a predetermined time. In one variation, the motor 60A can provide direct feedback as to the number of revolutions of the driven rollers 56/58, indicative of an amount of the sheet material fed thereby. Alternatively, a motor revolution counter can be provided that measures the degree of rotation of the driven rollers 56/58 and is interfaced with control circuitry 5 (e.g., the controller 100 thereof) to stop the motor 60A after a defined number of revolutions of the motor 60A and/or the driven rollers 56/58. This counter may be an optical encoder type of device, or a mechanical device. The control circuitry 5 may include a device to allow maintenance personnel to adjust the sheet length by increasing or decreasing the revolution counter set point. The multi-position switch 162 can also be in operable communication with the control circuitry 5 to select one of a plurality of time periods as a delay between delivery of an initial sheet and delivery of a next sheet to the user. Embodiments of the present disclosure described herein can also utilize concepts disclosed in U.S. Pat. Nos. 7,213,782 and 7,370,824, both of which are incorporated by reference herein as if set forth in their entireties, as well as U.S. patent application Ser. No. 13/155,528, which also is incorporated by reference herein as if set forth in its entirety.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A dispenser assembly facilitating selective dispensing of sheet material from a plurality of supplies of sheet material, comprising:

a dispenser housing having a plurality of support assemblies rotatably supporting the plurality of supplies of sheet material within the dispenser housing, and a discharge for dispensing of the sheet material from the plurality of supplies of sheet material from the dispenser housing; the plurality of supplies of sheet material including a first supply of sheet material and a second supply of sheet material respectively supported within the dispenser housing by a first support assembly and a second support assembly of the plurality of support assemblies;

a plurality of guide rollers positioned along and engaging the plurality of supplies of sheet material, the plurality of guide rollers including a first guide roller engaging the first supply of sheet material and a second guide roller engaging the second supply of sheet material; and a drive system configured to facilitate dispensing of the sheet material from the plurality of supplies of sheet material along respective discharge paths and from the discharge of the dispenser housing, the drive system including:

a plurality of driven rollers including a first driven roller corresponding to the first supply of sheet material and configured to engage and move sheet material from the first supply of sheet material along a first discharge path, and a second driven roller corresponding to the second supply of sheet material and configured to engage and move sheet material from the second supply of sheet material along a second discharge path;

a drive mechanism connected to the plurality of driven rollers by a belt driven transmission, the drive mechanism being driven in a first direction to drive the first driven roller and dispense the sheet material from the first supply of sheet material, and the drive mechanism being driven in a second direction to drive the second driven roller and dispense the sheet material from the second supply of sheet material.

2. The dispenser assembly of claim 1, wherein the second driven roller remains generally stationary when the drive mechanism is driven in the first direction to drive the first driven roller, and wherein the first driven roller remains substantially stationary when the drive mechanism is driven in the second direction to drive the second driven roller.

3. The dispenser assembly of claim 1, wherein the belt drive transmission includes a drive belt that operatively engages the drive mechanism, the first driven roller, and the second driven roller for driving of the first driven roller or the second driven roller.

4. The dispenser assembly of claim 3, further comprising:

a first driven roller belt gear operatively connected to the first driven roller;

a second driven roller belt gear operatively connected to the second driven roller; and a drive mechanism belt gear operatively connected to the drive mechanism, wherein the drive belt engages the first driven roller belt gear, the second driven roller belt gear, and the drive mechanism belt gear to transfer power between the drive mechanism and the first driven roller or the second drive roller.

5. The dispenser assembly of claim 4, wherein the first driven roller belt gear and the second drive roller belt gear each include a clutch mechanism, wherein when the drive mechanism is driven in the first direction, the clutch mechanism of the first driven roller engages to transfer power to the first driven roller so that the first driven roller is driven by the drive mechanism and rotated to dispense the sheet material from the first supply of sheet material, while the clutch mechanism of the second driven roller is substantially disengaged such that the second driven roller remains substantially stationary, and wherein when the drive mechanism is driven in the second direction, the clutch mechanism of the second driven roller engages to transfer power to the second driven roller so that the second driven roller is driven by the drive mechanism and rotated to dispense the sheet material from the second supply of sheet material, while the clutch mechanism of the first driven roller is substantially disengaged such that the first driven roller remains substantially stationary.

6. The dispenser assembly of claim 3, further comprising a tensioning assembly including a bracket movably supporting the drive mechanism along the dispenser housing, and one or more biasing members coupled to the bracket and configured to bias the tensioning assembly an amount sufficient to apply tension along the drive belt and/or for providing dampening of vibrations from an operation of the dispenser assembly.

7. The dispenser assembly of claim 1, further comprising at least one cutting mechanism positioned along the discharge of the dispenser housing for severance of dispensed sheet material from the first supply of sheet material or second supply of sheet material.

8. The dispenser assembly of claim 7, further comprising a pawl member assembly with a pivotally mounted pawl member located proximate the cutting mechanism such that movement of the dispensed sheet material into the cutting mechanism moves the pawl member from a first position to a second position, wherein the pawl member assembly transmits one or more signals to a control circuit of the dispenser housing if the pawl member is moved to the second position to notify the control circuit that a portion of the dispensed sheet material has been removed.

9. The dispensing assembly of claim 8, further comprising sheet material detection sensors each including an emitter and a detector focused across at least a portion of the discharge paths, wherein the sheet material detection sensor facilitates verification that a portion of the dispensed sheet material has been removed from the discharge.

10. The dispensing assembly of claim 1, further comprising:

a monitoring system configured to determine a supply level of the first or second supply of sheet material, wherein upon a determination that the supply level of the first or second supply of sheet material is below a threshold level, the direction of the drive mechanism is changed from the first direction to the second direction to dispense the sheet material from the second supply of sheet material or from the second direction to the first direction to dispense the sheet material from the first supply of sheet material.

11. A dispenser assembly facilitating selective dispensing of sheet material from a plurality of supplies of sheet material, comprising:

a dispenser housing having a plurality of support assemblies each rotatably supporting a corresponding supply of sheet material of the plurality of supplies of sheet material within the dispenser housing, and a discharge for dispensing of the sheet material from the plurality of supplies of sheet material from the dispenser housing;

a plurality of guide rollers positioned along and engaging the plurality of supplies of sheet material; and a drive system that facilitates dispensing of the sheet material from the plurality of supplies of sheet material along respective discharge paths and from the discharge of the dispenser housing, the drive system including:

a plurality of driven rollers each configured to engage and move sheet material from a respective supply of sheet material along a discharge path and from the discharge of the dispenser housing;

a drive mechanism connected to the plurality of driven rollers by a belt driven transmission, wherein when the drive mechanism is driven in one direction, one of the plurality of driven rollers is rotated to dispense sheet material from its respective supply of sheet material, and when the drive mechanism is driven in the opposite direction, another one of the plurality of driven rollers is rotated to dispense sheet material from its respective supply of sheet material.

12. The dispensing assembly of claim 11, wherein the plurality of support assemblies each include one or more slots or grooves defined within or along the dispenser housing that are configured to receive an end portion of the corresponding supplies of sheet material, wherein the one or more slots or grooves are configured such that as the sheet material is fed from the plurality of supplies of sheet material a substantially constant downward is force exerted by the plurality of supplies of sheet material on their corresponding guide rollers of the plurality of guide rollers.

13. The dispenser assembly of claim 11, wherein the belt drive transmission includes a drive belt that operatively engages the drive mechanism and the plurality of driven rollers for transferring power between the drive mechanism and the plurality of drive rollers.

14. The dispenser assembly of claim 13, further comprising a tensioning assembly including a bracket movably supporting the drive mechanism along the dispenser housing, and one or more biasing members coupled to the bracket and configured to bias the tensioning assembly sufficient to apply tension along the drive belt and/or for providing dampening of vibrations from an operation of the dispenser assembly.

15. The dispensing assembly of claim 11, wherein each of the plurality of driven rollers includes a clutch mechanism integrated therewith that facilitates selective rotation of the plurality of driven rollers based on the driving direction of the drive mechanism.

16. The dispenser assembly of claim 11, further comprising at least one cutting mechanism positioned along the discharge of the dispenser housing for severance of dispensed sheet material from the plurality of supplies of sheet material.

17. The dispenser assembly of claim 16, further comprising a pawl member assembly with a pivotally mounted pawl member located proximate the at least one cutting mechanism such that movement of the dispensed sheet material into the cutting mechanism moves the pawl member and causes the transmission of one or more signals to a control circuit of the dispenser housing to notify the control circuit that a portion of the dispensed sheet material has been removed.

18. The dispensing assembly of claim 11, further comprising a sheet material detection sensor positioned along the discharge to verify that sheet material has been removed from the discharge.

19. The dispensing assembly of claim 11, further comprising a monitoring system configured to determine a supply level of one or more of the plurality of supplies of sheet material, wherein upon a determination that the supply level is below a threshold level, the direction of the drive mechanism is changed.

20. The dispensing assembly of claim 11, wherein the plurality of support assemblies each include one or more slots or grooves defined within or along the dispenser housing that are configured to receive an end portion of the corresponding supplies of sheet material, wherein the one or more slots or grooves are configured such that as the sheet material is fed from the plurality of supplies of sheet material a substantially constant downward is force exerted by the plurality of supplies of sheet material on their corresponding driven rollers of the plurality of driven rollers.

* * * * *